US009850038B2

(12) United States Patent
Petkovsek et al.

(10) Patent No.: US 9,850,038 B2
(45) Date of Patent: Dec. 26, 2017

(54) CHILD RESISTANT ZIPPER CLOSURE FOR RECLOSEABLE POUCH WITH DOUBLE SLIDER AND METHODS

(71) Applicant: Reynolds Presto Products Inc., Richmond, VA (US)

(72) Inventors: Gregory L. Petkovsek, Waupaca, WI (US); Roger E. Dowler, Rochester, MN (US); Gregg Thompson, Canandaigua, NY (US); Samuel D. Aversa, Canandaigua, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 518 days.

(21) Appl. No.: 14/202,585

(22) Filed: Mar. 10, 2014

(65) Prior Publication Data

US 2014/0311101 A1 Oct. 23, 2014

Related U.S. Application Data

(60) Provisional application No. 61/792,384, filed on Mar. 15, 2013.

(51) Int. Cl.

| | |
|---|---|
| ***A44B 19/26*** | (2006.01) |
| ***B65D 33/25*** | (2006.01) |
| *A44B 19/38* | (2006.01) |

(52) U.S. Cl.

CPC ..... *B65D 33/2591* (2013.01); *A44B 19/267* (2013.01); *A44B 19/382* (2013.01); *Y10T 24/2502* (2015.01)

(58) Field of Classification Search

CPC ..... B65D 33/2591; Y10T 24/2502; A44B 19/267; A44B 19/382

See application file for complete search history.

(56) References Cited

U.S. PATENT DOCUMENTS 4,395,891 A * 8/1983 Remington ..... A44B 19/301 70/68

4,514,884 A 5/1985 Kaneko (Continued)

FOREIGN PATENT DOCUMENTS

CN 102490974 6/2012

CN 102490974 A 6/2012

(Continued)

OTHER PUBLICATIONS

International Search Report and Written Opinion for PCT/US2014/023669 dated Jun. 20, 2014.

(Continued)

*Primary Examiner* — Robert J Sandy

*Assistant Examiner* — David Upchurch

(74) *Attorney, Agent, or Firm* — Merchant & Gould P.C.

(57) ABSTRACT

A child resistant zipper closure for a plastic bag includes a double slider, including a first slider and second slider. The first and second sliders are oriented on the zipper closure such that when at least one of the first slider and second slider is moving in a direction toward the other of the first slider and second slider, the zipper is interlocking; and when at least one of the first slider and second slider is moving in a direction away from the other of the first slider and second slider, the zipper is unlocking. The first and second sliders can be releasably connected together.

7 Claims, 5 Drawing Sheets

(56) References Cited

U.S. PATENT DOCUMENTS

| | | | | |
|---|---|---|---|---|
| 4,578,966 | A * | 4/1986 | Kasai | A44B 19/301 24/418 |
| 4,976,120 | A * | 12/1990 | Terada | A44B 19/301 70/312 |
| 4,991,873 | A * | 2/1991 | Matsui | B60R 22/06 16/95 R |
| 5,007,143 | A * | 4/1991 | Herrington | B65D 33/2591 24/399 |
| 5,010,627 | A * | 4/1991 | Herrington | B65D 33/2591 24/399 |
| 5,063,760 | A * | 11/1991 | Horita | A44B 19/301 70/23 |
| 5,283,932 | A | 2/1994 | Richardson et al. | |
| 5,711,609 | A | 1/1998 | Simonsen | |
| 6,361,213 | B2 | 3/2002 | Randall | |
| 6,376,035 | B1 | 4/2002 | Dobreski et al. | |
| 6,431,754 | B1 * | 8/2002 | Savicki, Sr. | A44B 19/267 156/73.1 |
| 6,510,593 | B1 * | 1/2003 | Kim | A44B 19/301 24/382 |
| 6,611,996 | B2 * | 9/2003 | Blythe | A44B 19/267 24/399 |
| 7,073,233 | B2 * | 7/2006 | Leva | A44B 19/26 24/386 |
| D526,931 | S * | 8/2006 | Koenig | D11/221 |
| 7,251,864 | B2 | 8/2007 | Chang | |
| 7,506,417 | B2 * | 3/2009 | Yoneoka | A44B 19/301 24/386 |
| 7,574,782 | B2 * | 8/2009 | Ackerman | A44B 19/267 24/400 |
| 7,670,052 | B2 | 3/2010 | Chaturvedi | |
| 8,087,826 | B1 | 1/2012 | Blythe et al. | |
| 2003/0014848 | A1 | 1/2003 | LaRue et al. | |
| 2003/0051318 | A1 * | 3/2003 | ErkenBrack | B65D 33/2591 24/428 |
| 2003/0217444 | A1 * | 11/2003 | Blythe | B65D 33/2591 24/399 |
| 2004/0161168 | A1 * | 8/2004 | Crunkleton | B65D 33/2591 383/64 |
| 2005/0084183 | A1 * | 4/2005 | Ausnit | B65D 33/2591 383/64 |
| 2005/0204516 | A1 | 9/2005 | Leva et al. | |
| 2010/0011545 | A1 | 1/2010 | Anzini | |
| 2011/0126384 | A1 * | 6/2011 | Ozaki | B65D 33/2591 24/430 |

FOREIGN PATENT DOCUMENTS

| | | | |
|---|---|---|---|
| EP | 365830 | A3 | 5/1990 |
| EP | 377798 | B1 | 1/1994 |
| EP | 1752057 | A2 | 2/2007 |
| GB | 1477290 | A | 6/1977 |
| WO | 9508280 | A1 | 3/1995 |
| WO | WO 02/03824 | | 1/2002 |
| WO | WO 2007/038465 | | 4/2007 |
| WO | WO 2013/078722 | A1 | 6/2013 |

OTHER PUBLICATIONS

New Zealand Examination Report in Application 711247; dated Jul. 6, 2017, 6 pgs.

* cited by examiner

CHILD RESISTANT ZIPPER CLOSURE FOR RECLOSEABLE POUCH WITH DOUBLE SLIDER AND METHODS

This application claims priority to U.S. provisional patent application 61/792,384, filed Mar. 15, 2013, incorporated herein by reference in its entirety.

TECHNICAL FIELD

This disclosure relates to reclosable zipper pouch. More particularly, this disclosure relates to a reclosable zipper pouch that is child resistant.

BACKGROUND

A reclosable pouch having a slider operated zipper closure is easy to open for children and adults. If the pouch is intended to have contents that are potentially harmful, there is a need to provide a closure and method to increase the difficulty for children to open the pouch and yet still be easy to open for adults and senior citizens.

SUMMARY

In one aspect, this disclosure provides a child resistant slider zipper closure system having two moveable sliders.

The sliders can be physically linked together and slide as a single unit.

The two sliders can be physically released from one another and slide individually.

There can be a method of releasing the sliders from one another is not intuitive to children.

The method of releasing the sliders from one another can require physical dexterity not typical of small children.

When the sliders are linked, the zipper closure remains closed when the linked sliders are slid in any direction.

When the sliders are released from one another, the zipper closure can be opened by moving one or both sliders in a direction opposite one another.

In another aspect, this disclosure provides a flexible package with a child resistant slider zipper closure system having two moveable sliders.

In the package, the two sliders can be physically linked together and slide as a single unit.

In the package, the two sliders can be physically released from one another and slide individually.

In the package, there is method of releasing the sliders from one another that is not intuitive to children.

In the package, the method of releasing the sliders from one another requires physical dexterity not typical of small children.

In the package, when the sliders are linked, the zipper closure remains closed and the linked sliders can be slid in any direction.

In the package, when the sliders are released from one another, the zipper closure can be opened by moving one or both sliders in a direction opposite one another.

In another aspect, a double slider for a plastic zipper closure having a male track and a female track including interlocking male and female profiles is provided. The double slider includes a first slider and a second slider. Each of the first slider and second slider has a body with an opening end and a closing end. The body includes a top member and first and second legs extending therefrom. Each of the sliders has a separator finger depending from an internal surface of the top member and between the first and second legs. The slider body of each is adapted to move along top edges of the tracks with the first and second legs straddling the tracks, and the finger positioned between the tracks. The separator finger is wider toward the opening end of the slider than at the closing end of the slider. The first and second legs have internal surfaces that are spaced wider apart toward the opening end to permit separation of the male and female profiles by the wider end of the finger extending between the first and second legs toward the opening end. The first and second legs having internal surfaces spaced sufficiently close together toward the closing end to press the male and female profiles into interlocking relationship as each slider is moved in a fastener closing direction. The first slider and second slider are selectively releasably connected together between an engaged position and a disengaged position. In the engaged position, the first and second slider is moved together along the top edges of the track, and the opening end of the first slider body is against the opening end of the second slider body. In the disengaged position, the first and second sliders move independent of each other along the top edges of the track.

In example aspects, the first slider and second slider have a projection-receiver arrangement to allow the selective releasable connection therebetween.

In another aspect, a zippered plastic bag having an openable and reclosable mouth is provided. The bag includes first and second panels each having a top forming the mouth, a bottom, and first and second opposing sides. The first and second panels are joined to each other along the respective bottoms, their respective first opposing sides, and their respective second opposing sides. The bag includes a zipper closure including a male and a female track. The male track includes a male profile in proximity to the top of the first panel. The female track includes a female profile in proximity to the top of the second panel. The male and female profiles have complementary cross sections for interlocking to close the mouth and for unlocking to open the mouth. A first slider is located on the zipper closure. The first slider cooperates with the zipper closure in opening and closing the mouth by moving along the male and female tracks. A second slider is located on the zipper closure. The second slider cooperates with the zipper closure in opening and closing the mouth by moving along the male and female tracks. The first slider and the second slider are oriented on the zipper closure such that when at least one of the first slider and second slider is moving in a direction toward the other of the first slider and second slider, the zipper closure is interlocking. When at least one of the first slider and second slider is moving in a direction away from the other of the first slider and second slider, the zipper closure is unlocking.

In example aspects, the first slider and second slider are releasably connected together.

In example aspects, the first slider and second slider have a projection-receiver arrangement to allow the selective releasable connection therebetween.

In another aspect, a method of operating a zippered plastic bag having an openable and reclosable mouth is provided. The method includes providing a zippered plastic bag including a zipper closure with male and female tracks. The male track includes a male profile, and the female track includes a female profile. The male and female profiles have complementary cross sections for interlocking to close the bag mouth and for unlocking to open the bag mouth. A first slider is located on the zipper closure, and a second slider is located on the zipper closure. The method includes opening the mouth by unlocking the zipper closure by moving at least one of the first slider and second slider in a direction away from the other of the first slider and second slider.

In example aspects, the method further includes closing the mouth by interlocking the zipper closure by moving at least one of the first slider and second slider in a direction toward the other of the first slider and second slider.

In example aspects, the step of opening the mouth by unlocking the zipper closure includes releasing a connection between the first slider and second slider.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 1:
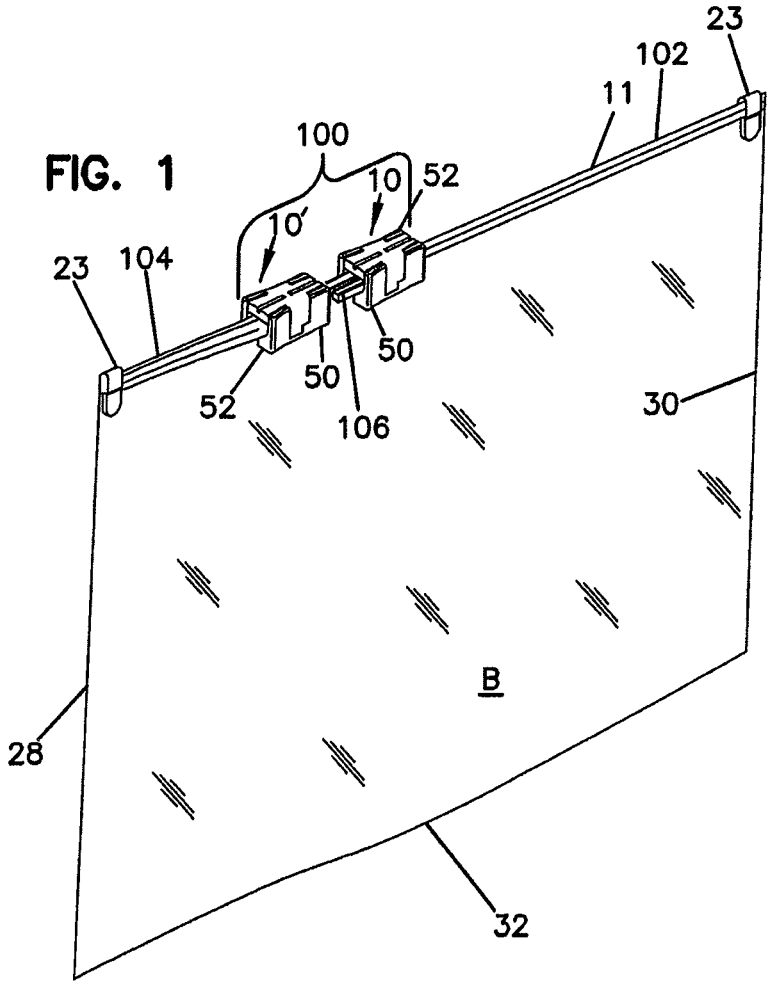
FIG. 1 is a perspective view of a thermoplastic bag having a fastener and double slider in a disengaged position, constructed in accordance with principles of this disclosure.

Referring to FIG. 1, there is illustrated a plastic double slider 100 and a profiled plastic fastener or zipper closure 11. The double slider 100 includes a first slider 10 and a second slider 10', which can be selectively engaged (or connected) and disengaged (or disconnected).

Figure 2:
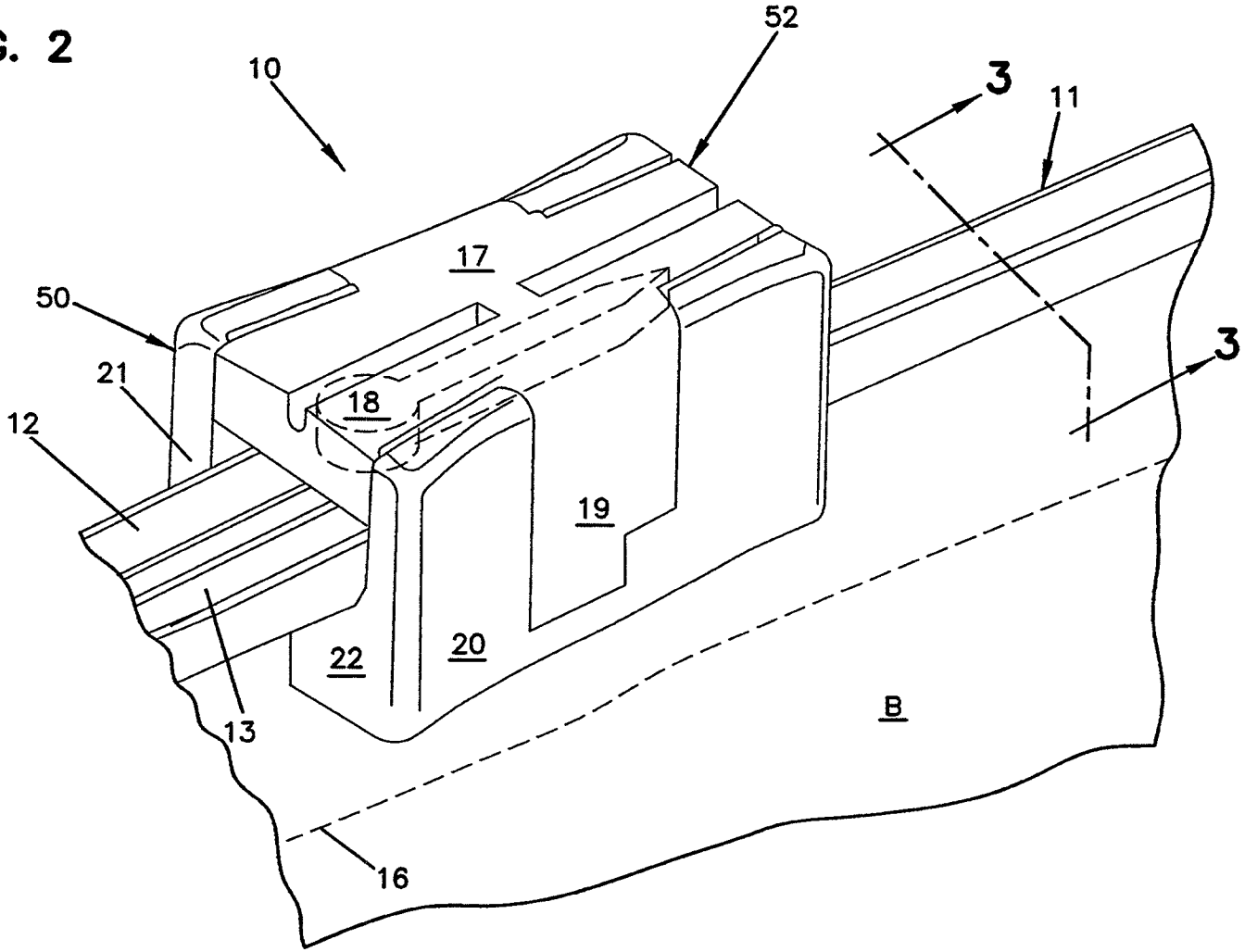
FIG. 2 is an enlarged perspective view of the fastener and one of the sliders of FIG. 1 in assembled position on a thermoplastic bag.

The first slider 10 has been illustrated in FIG. 2 assembled on the zipper closure 11 at the top edge or mouth 40 of a thermoplastic bag or package B. It should be understood that the first slider 10 and second slider 10' have the same internal structure, and they operate to open and close the bag B in the same manner, but in opposite directions. Thus, description of first slider 10 is also a description of second slider 10'.

Figure 3:
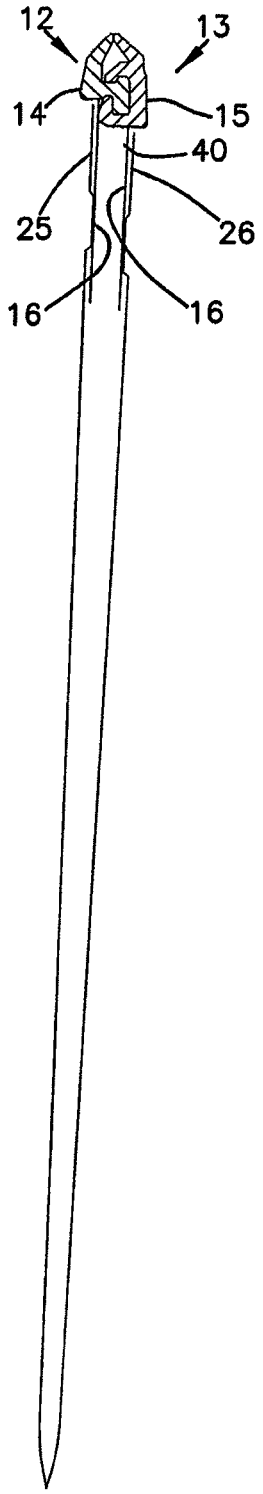
FIG. 3 is a cross-sectional view taken generally along lines 3--3 in FIG. 2.

In the example embodiment, the bag B (as shown in FIGS. 1 and 3) is formed from a single flexible plastic sheet folded upon itself and comprises first and second opposing body panels 25 and 26. Body panels 25 and 26 are fixedly connected to each other along a pair of sides 28 and 30 and a bottom 32 which extends between the pair of sides 28 and 30. Bag B preferably has the zipper closure 11 extending along a mouth formed opposite the bottom 32 of bag B, in which the zipper closure 11 has a male track 12 and a female track 13.

As shown in FIGS. 2 and 3, tracks 12 and 13 have interlocking male and female profiles 14 and 15 extending the length thereof in the form of rib and groove elements on the respective tracks. The tracks 12 and 13 may be extruded separately with a fin and attached to the respective sides of the bag mouth 40, or may be extruded integrally with the sides of the bag mouth 40. If the tracks 12 and 13 are extruded separately, they are most effectively attached by means of a respective first and second fin 16, incorporated within the tracks, that is heat sealed to the bag mouth 40. The male and female profiles 14 and 15 have complementary cross-sectional shapes and are closed by pressing a bottom of the elements together first and then rolling the elements to a closed position toward the top thereof. The cross-sectional shapes of the interlocking male and female profiles 14 and 15 are described in U.S. Pat. No. 5,007,143, which is incorporated herein by reference.

In FIG. 2, only the first slider 10 is illustrated. The first slider 10 straddles the zipper closure 11 at the top of the bag B and is adapted for opening or closing the interlocking tracks 12 and 13 of the zipper closure 11. The first slider 10 and second slider 10' may be molded from any suitable plastic such as, for example, nylon, polypropylene, polyethylene, polystyrene, Delrin, or ABS. The first slider 10 and second slider 10', in this example, is described in U.S. Pat. No. 6,376,035, which is incorporated herein by reference.

In an example embodiment, shown in FIG. 2, the first slider 10 comprises an inverted U-shaped member including a transverse support member or body 17 from which the separator finger 18 extends downward. The body 17 is itself U-shaped and includes two integral legs 19 extending downward. The finger 18 is positioned between the legs 19. The body further includes opposite side walls 20, 21, which each has an inwardly extending shoulder structure 22. The body 17 is adapted to move along the top edges of the tracks 12 and 13 with the legs 19 straddling these elements and the finger 18 positioned between the tracks 12 and 13. Shoulder structure 22 engages a bottom of the zipper closure 11 to prevent the first slider 10 from being lifted off the edges of the tracks 12 and 13, while the first slider 10 straddles the zipper closure 11.

The first slider 10 has an opening end 50 and a closing end 52. It will also be noted that the main slider body 17 and the separator finger 18 are wider toward the opening end 50 than at the closing end 52. Similarly, the side walls 20 and 21 and the legs 19 have internal surfaces that are spaced wider apart at or adjacent or toward the opening end 50 of the first slider 10 to permit separation of the male and female profiles 14 and 15 by the finger 18 engaging the tracks 12 and 13. The sidewalls 20 and 21 and legs 19 have internal surfaces that are spaced sufficiently close together at or adjacent or toward the closing end 52 of the first slider 10 to press the male and female profiles 14 and 15 into an interlocking relationship as the first slider 10 is moved in a fastener closing direction. Many embodiments are possible, and it should be understood that external surfaces of the first slider 10 can take almost any configuration without affecting the operation of the slider 10.

In this example embodiment, the opposite ends of the zipper closure 11 are provided with end termination clips 23 (FIG. 1). Each end clip 23 comprises a strap member which wraps over the top of the zipper closure 11.

As mentioned previously, the first slider 10 and second slider 10' have the same internal structure, and they operate to open and close the bag in the same manner, but in opposite directions. Thus, from a review of FIG. 1, it should be appreciated that the first slider 10 and second slider 10' are oriented on the zipper closure 11 such that when at least one of the first slider 10 and second slider 10' is moving in a direction toward the other of the first slider 10 and second slider 10', the zipper closure 11 is interlocking, to close the mouth 40. When at least one of the first slider 10 and second slider 10' is moving in a direction away from the other of the first slider 10 and second slider 10', the zipper closure 11 is unlocking, and the mouth 40 is opening.

In the example shown in FIG. 1, when the first slider 10 is moved in a direction toward side 30, and away from the second slider 10', the zipper closure 11 between the second slider 10' and first slider 10 is unlocking, and the mouth 40 is opening in that section. When the first slider 10 is moving in a direction away from side 30 and in a direction toward second slider 10' and toward side 28, the zipper closure 11 is interlocking to close the mouth for the zipper closure section that is between the first slider 10 and the side 30.

Similarly, when the second slider 10' is moving in a direction toward the side 28 and away from the first slider 10, the zipper closure 11 between the first slider 10 and second slider 10' is unlocking to open the mouth 40 in that section. When the second slider 10' is moving toward side 30 and first slider 10, the zipper closure 11 between the side 28 and second slider 10' is closing.

As can be seen in FIG. 1, the first slider 10 and second slider 10' are oriented on the zipper closure 11 relative to each other such that the opening end 50 of each first slider 10 and second slider 10' are adjacent to each other, when the first slider 10 and second slider 10' are in engagement next to each other. It can be seen that the opening end 50 of the first slider 10 is closer to the opening end 50 of the second slider 10' than it is to the closing end 52 of the second slider 10'. Similarly, the opening end 50 of the second slider 10' is closer to the opening end 50 of the first slider 10 than it is to the closing end 52 of the first slider 10.

When the first slider 10 and second slider 10' are immediately adjacent to each other and the closing ends 50 are against each other, it should be appreciated that when the first slider 10 and second slider 10' are moved together along the zipper closure 11, the zipper closure 11 will remain interlocked and the mouth 40 closed in the sections 102, 104 of the zipper closure 11 that are between the respective closing end 52 and the sides 28, 30. In the example shown in FIG. 1, the section 102 remains closed between closing end 52 of the first slider 10 and the side 30, while the section 104 remains closed between the closing end 52 of the second slider 10' and the side 28. In the example shown in FIG. 1, there is a section 106 of the zipper closure 11 that is unlocked to provide an opening at the mouth 40. The section 106 is a section between the opening ends 50 of the first slider 10 and second slider 10'.

In accordance with principles of this disclosure, the first slider 10 and second slider 10' can be selectively releasably connected together between an engaged position and a disengaged position. In the engaged position, the first and second sliders 10, 10' move together along the top edges of the tracks 12, 13. In the disengaged position, the first and second sliders 10, 10' move independent of each other along the top edges of the tracks 12, 13. When the sliders 10, 10' are engaged and move together, the zipper closure 11 will remain interlocked and the mouth 40 closed in the sections 102, 104 of the zipper closure 11 that are between the closing end 52 and the sides 28, 30. This can function as a child-resistant feature to opening the mouth 40 in that a child will not easily understand that the first and second sliders 10, 10' need to be separated or disengaged and moved apart from each other to unlock the zipper closure 11 and open the mouth 40.

FIGS. 4-8 show example embodiments of engagement structure to allow the releasable connection between the first slider 10 and second slider 10'. The examples shown in FIGS. 4-8 are each double sliders 100, including first and second sliders that can function as described for first slider 10 and second slider 10'. Of course, alternatives are possible.

In general, the releasable connection between the first slider 10 and second slider 10' can be a projection-receiver arrangement 110. The projection-receiver arrangement 110 allows for selective releasable connection between the first slider 10 and second slider 10'. The projection-receiver arrangement 110 will include at least one of a projection 112 and one of a receiver 114. The projection 112 can be on either the first slider 10 or second slider 10'. Similarly, the receiver 114 can be on either the first slider 10 or second slider 10'. The projection 112 and receiver 114 are complementary to each other, such that the receiver 114 is sized to receive the projection 112 to operably connect the first slider 10 and second slider 10', and also to allow selective disconnection by removing the projection 112 from the receiver 114.

Figure 7:
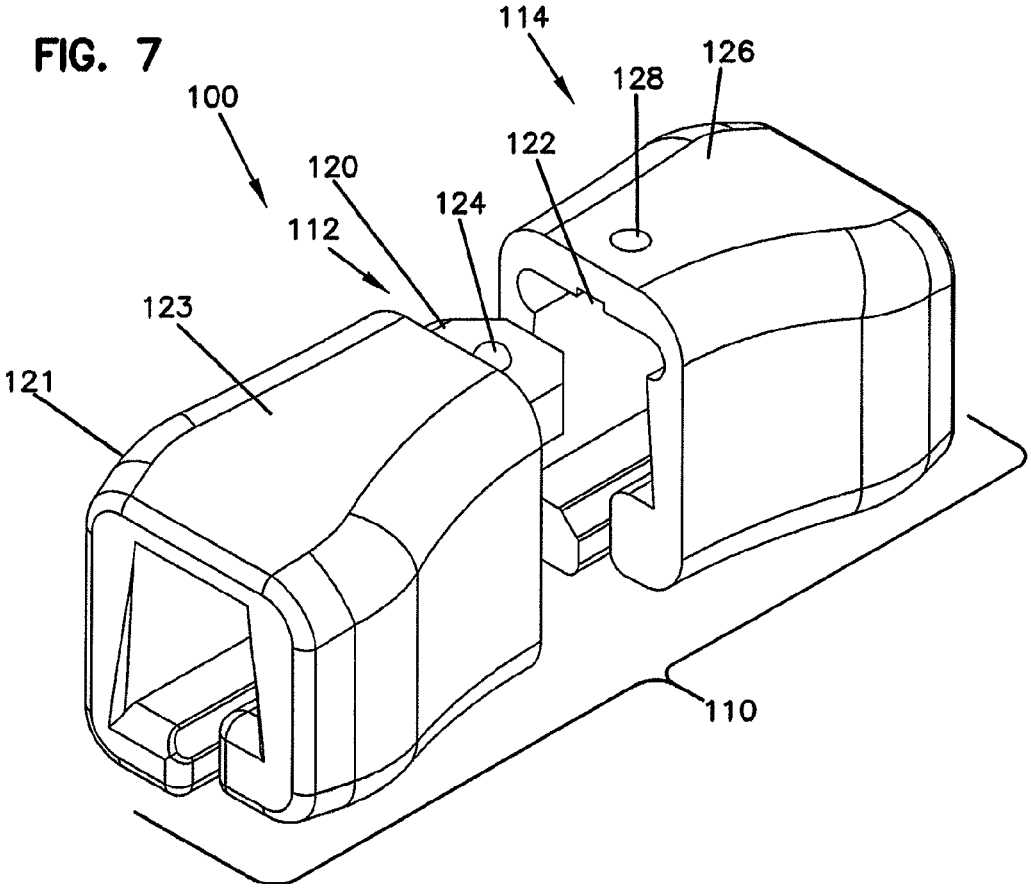
FIG. 7 is a schematic perspective view of another example embodiment of a double slider, useable with the fastener of FIGS. 1-3, the double slider being in a disengaged position.

In the example embodiment of FIG. 7, the projection-receiver arrangement 110 includes tab 120 on a first slider 121. The tab 120, in the embodiment show, generally extends from a top member 123 of the first slider 121, and is recessed from a top plane of the top member 123. The tab 120 has a protuberance 124 projecting therefrom. The second slider 122 is sized to receive the tab 120 just below the top member 126 of the second slider 122. There is an aperture 128 in the second slider 122 oriented to receive the protuberance 124. In the embodiment shown, the aperture 128 is in the top member 126. In this manner, the tab 120 is received by the second slider 122 under the top member 126 of the second slider 122, and the protuberance 124 can be releasably fitted within the aperture 128.

Figure 8:
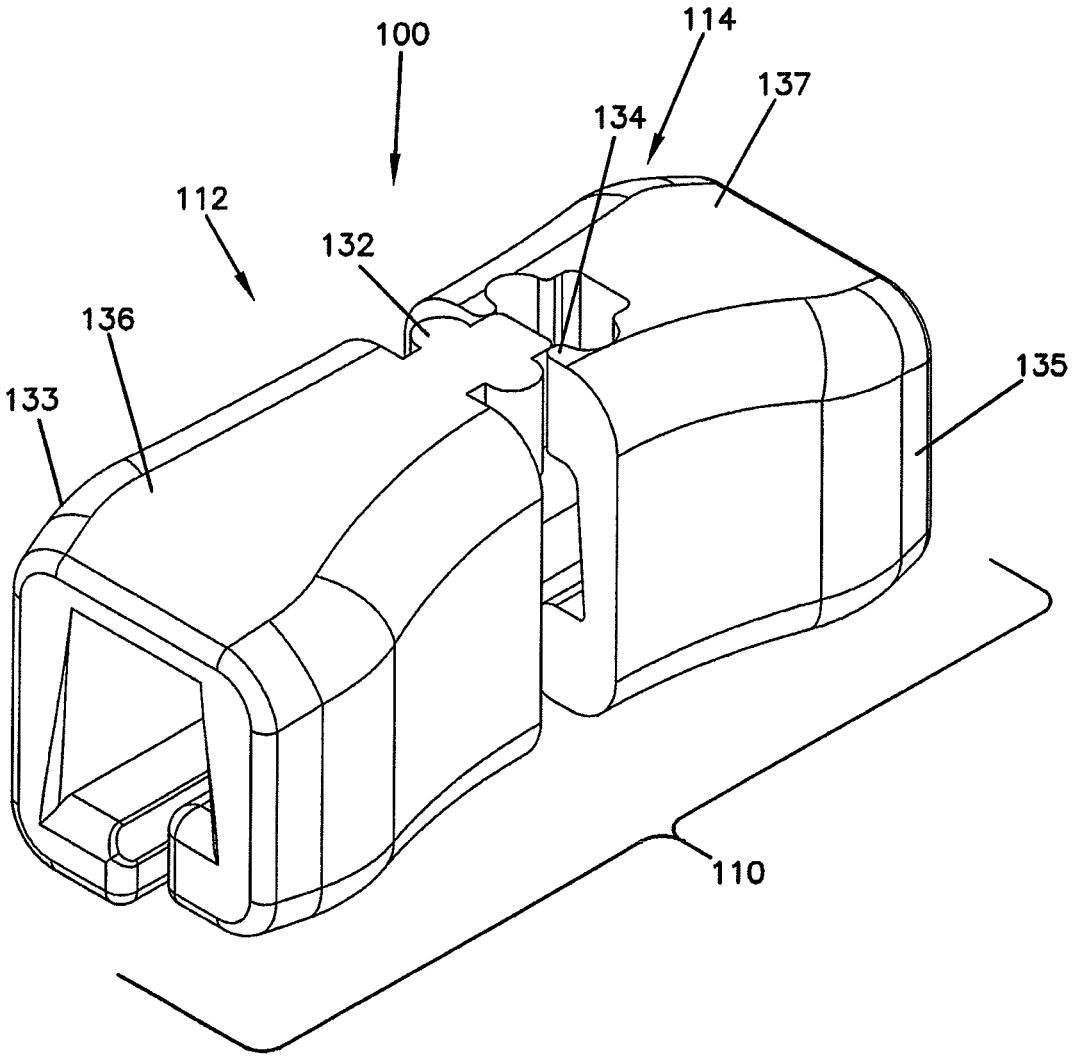
FIG. 8 is a schematic perspective view of another example embodiment of a double slider, useable with the fastener of FIGS. 1-3, the double slider being in a disengaged position.

In the example shown in FIG. 8, the projection-receiver arrangement 110 includes a lobed projection 132 extending from first slider 133, and an aperture 134 in the second slider 135 sized to receive the lobed projection 132. In the example embodiment shown, the lobed projection 132 extends from the top member 136 of the first slider 133. The lobed projection 132 is shown with three lobes, but of course, many other shapes for the lobed projection 132 are possible. The aperture 134, in this embodiment, is in the top member 137 of the second slider 135. The aperture 134 is shaped as the complement of the lobed projection 132. Of course, alternatives are possible.

Figure 4:
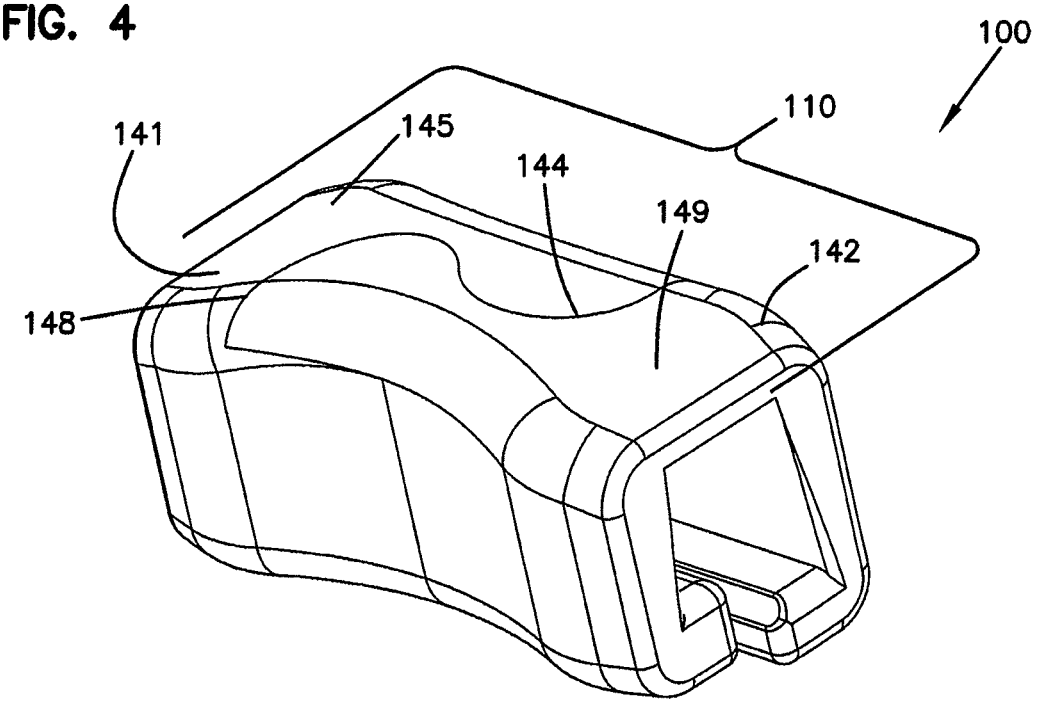
FIG. 4 is a schematic perspective view of an example embodiment of a double slider, useable with the fastener of FIGS. 1-3, the double slider being in an engaged position.
Figure 5:
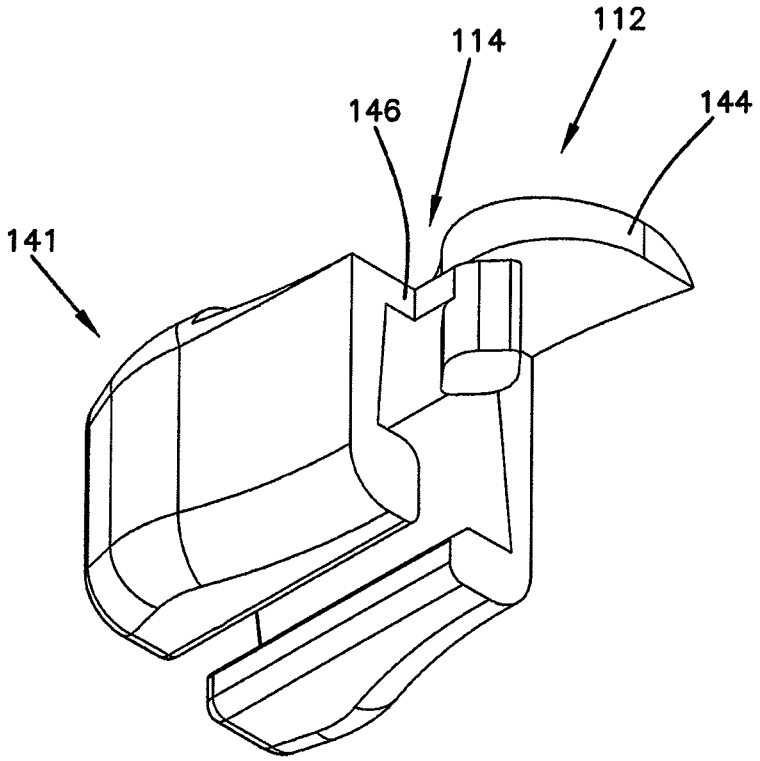
FIG. 5 is a schematic perspective view of one of the sliders of FIG. 4.
Figure 6:
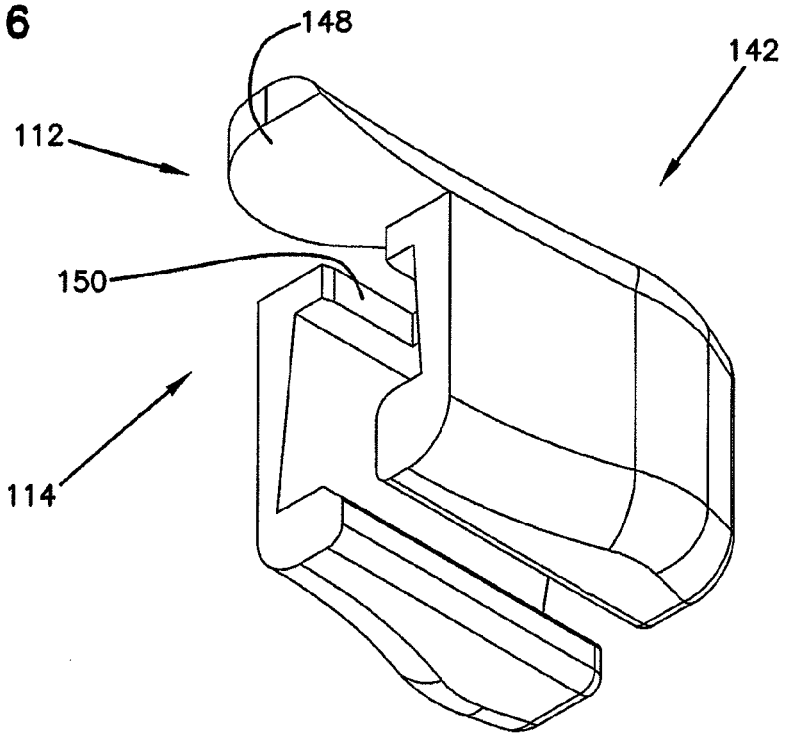
FIG. 6 is a schematic perspective view of one of the sliders of FIG. 4.

In FIGS. 4-6, first slider is shown at 141, while second slider is shown at 142. In this embodiment, each of the first slider 141 and second slider 142 has both projection 112 and receiver 114. In FIG. 5, the first slider 141 can be seen having projection 144, extending as part of its top member 145. The first slider 141 also includes receiver 146 which is adjacent to the projection 144 in the top member 145. In FIG. 6, the second slider 142 has projection 148 as part of its top member 149, and an adjacent receiver 150 defined by the top member 149. The projection 144 of the first slider 141 is received by the receiver 150, while the projection 148 of the second slider 142 is received by the receiver 146 of the first slider 141.

A method of operating a zippered plastic bag can be applied using these principles. A bag, such as bag B of FIG. 1 can be provided. There is a step of opening the mouth 40 by unlocking the zipper closure 11 by moving at least one of the first slider 10 and second slider 10' in a direction away from the other of the first slider 10 and second slider 10'.

There is a step of closing the mouth 40 by interlocking the zipper closure 11 by moving at least one of the first slider 10 and second slider 10' in a direction toward the other of the first slider 10 and second slider 10'.

The step of opening the mouth 40 can include releasing a connection between the first slider 10 and second slider 10'. In some examples, this step of lacing a connection can include removing projection 12 from receiver 14 that is part of a projection-receiver arrangement between the sliders 10, 10'.

The above description represents example principles of this disclosure. Many embodiments can be made applying these principles.

What is claimed is:

1. A double slider for a plastic zipper closure having a male track and a female track including interlocking male and female profiles; the double slider comprising:

(a) a first slider having a body with an opening end and a closing end;

(i) the body including a top member and first and second sidewalls extending therefrom; the first slider having a separator finger depending from an internal surface of the top member and between the first and second sidewalls;

(A) the body adapted to move along top edges of the tracks with the first and second sidewalls straddling the tracks, and the finger penetrating between the tracks;

(ii) the separator finger being wider toward the opening end of the first slider than at the closing end of the first slider;

(iii) the first and second sidewalls having internal surfaces spaced wider apart toward the opening end configured to permit separation of the male and female profiles by the wider end of the finger extending between the first and second sidewalls toward the opening end;

(iv) the first and second sidewalls having internal surfaces spaced sufficiently close together toward the closing end configured to press the male and female profiles into interlocking relationship as the first slider is moved in a fastener closing direction;

(b) a second slider, releasably connected to the first slider, the second slider having a body with an opening end and a closing end;

(i) the second slider body including a top member and first and second sidewalls extending therefrom; the second slider having a separator finger depending from an internal surface of the top member and between the first and second sidewalls;

(A) the second slider body adapted to move along top edges of the tracks with the first and second sidewalls straddling the tracks and the finger penetrating between the tracks;

(ii) the second slider separator finger being wider toward the opening end of the second slider than at the closing end of the second slider;

(iii) the second slider first and second sidewalls having internal surfaces spaced wider apart toward the opening end configured to permit separation of the male and female profiles by the wider end of the finger extending between the first and second sidewalls toward the opening end;

(iv) the second slider first and second sidewalls having internal surfaces spaced sufficiently close together toward the closing end configured to press the male and female profiles into interlocking relationship as the second slider is moved in a fastener closing direction;

(c) the first slider and second slider being selectively releasably connected together between an engaged position and a disengaged position;

(i) in the engaged position, the first and second sliders move together along the top edges of the track, and the opening end of the first slider body is against the opening end of the second slider body;

(ii) in the disengaged position, the first and second sliders move independent of each other along the top edges of the track.

2. A double slider according to claim 1 wherein:

(a) the first slider and second slider have a projection-receiver arrangement to allow the selective releasable connection therebetween.

3. A double slider according to claim 2 wherein:

(a) at least one member of the projection-receiver arrangement is on the first slider, and at least one member of the projection-receiver arrangement is on the second slider.

4. A double slider according to claim 2 wherein:

(a) the projection-receiver arrangement includes a tab with a protuberance extending from one of the first and second sliders and an aperture sized to receive the protuberance in the other of the first and second sliders.

5. A double slider according to claim 2 wherein:

(a) the projection-receiver arrangement includes a lobed projection extending from one of the first and second sliders and an aperture sized to receive the lobed projection in the other of the first and second sliders.

6. A double slider according to claim 2 wherein:

(a) each of the first slider and second sliders has both a projection and a receiver.

7. A double slider according to claim 1 wherein:

(a) the first and second sidewalls of the first slider body extend to a point below the interlocking male and female profiles; and (b) the first and second sidewalls of the second slider body extend to a point below the interlocking male and female profiles.

* * * * *